US009932807B2

(12) United States Patent
Zhang

(10) Patent No.: US 9,932,807 B2
(45) Date of Patent: Apr. 3, 2018

(54) CONTROLLED GEYSER WELL

(71) Applicant: The University of Tulsa, Tulsa, OK (US)

(72) Inventor: Hong-quan Zhang, Tulsa, OK (US)

(73) Assignee: The University of Tulsa, Tulsa, OK (US)

( * ) Notice: Subject to any disclaimer, the term of this patent is extended or adjusted under 35 U.S.C. 154(b) by 578 days.

(21) Appl. No.: 14/374,501

(22) PCT Filed: Jan. 7, 2013

(86) PCT No.: PCT/US2013/020495
§ 371 (c)(1),
(2) Date: Jul. 24, 2014

(87) PCT Pub. No.: WO2013/112271
PCT Pub. Date: Aug. 1, 2013

(65) Prior Publication Data

US 2014/0360733 A1 Dec. 11, 2014

Related U.S. Application Data

(60) Provisional application No. 61/590,407, filed on Jan. 25, 2012.

(51) Int. Cl.

| | |
|---|---|
| ***E21B 43/16*** | (2006.01) |
| ***E21B 43/18*** | (2006.01) |
| ***E21B 21/16*** | (2006.01) |
| ***E21B 43/12*** | (2006.01) |
| ***E21B 21/14*** | (2006.01) |
| ***E21B 21/08*** | (2006.01) |
| ***E21B 43/40*** | (2006.01) |

(52) U.S. Cl.
CPC ..... *E21B 43/166* (2013.01); *E21B 21/08* (2013.01); *E21B 21/14* (2013.01); *E21B 21/16* (2013.01); *E21B 43/12* (2013.01); *E21B 43/122* (2013.01); *E21B 43/18* (2013.01); *E21B 43/40* (2013.01)

(58) Field of Classification Search
CPC ..... E21B 21/14; E21B 21/16; E21B 21/108; E21B 43/12; E21B 43/166; E21B 43/18; E21B 43/40
See application file for complete search history.

(56) References Cited

U.S. PATENT DOCUMENTS

| | | | | |
|---|---|---|---|---|
| 1,665,540 A * | 4/1928 | Green | ..... | E21B 43/12 166/105.5 |
| 2,202,462 A | 5/1940 | Nixon | | |
| 2,612,111 A | 9/1952 | Humason | | |

(Continued)

*Primary Examiner* — Cathleen R Hutchins
*Assistant Examiner* — Tara E Schimpf
(74) *Attorney, Agent, or Firm* — Gable Gotwals

(57) ABSTRACT

A system and method for creating a controlled geyser well with sustained periodical production includes a cap (16) which prevents gas from entering a well tubing (14) while allowing liquid to enter and accumulate in the tubing, means for compressing the gas, and means for injecting the gas in the annulus so that the gas enters the bottom end of the well tubing (14), thereby creating a controlled geyser effect which blows out most of the liquid residing in the well tubing (14). The gas being compressed can be a produced gas or a supplied gas.

8 Claims, 10 Drawing Sheets

(56) References Cited

U.S. PATENT DOCUMENTS

| | | | | |
|---|---|---|---|---|
| 6,367,555 | B1 * | 4/2002 | Senyard, Sr. | E21B 43/122<br>166/370 |
| 6,629,566 | B2 * | 10/2003 | Liknes | E21B 43/38<br>166/325 |
| 6,991,034 | B2 * | 1/2006 | Wilde | E21B 43/122<br>166/250.15 |
| 2011/0004352 | A1 * | 1/2011 | Wilde | E21B 34/06<br>700/282 |

* cited by examiner

CONTROLLED GEYSER WELL

CROSS-REFERENCE TO RELATED APPLICATIONS

This United States National Phase of PCT Application No. PCT/US2013/020495 filed 7 Jan. 2013 claims priority to United States Provisional Application No. 61/590,407 filed 25 Jan. 2012, each of which are incorporated herein by reference.

BACKGROUND OF THE INVENTION

This invention relates generally to systems, apparatuses and methods for bringing to the surface liquids contained in underground reservoirs. Specifically, the invention relates to systems, apparatuses and methods for creating a geyser-type flow and controlling it in such a way as to safely bring to the surface liquids contained in a reservoir.

A plunger pump reciprocated by a pump jack (or beam pumping unit) is the typical means used to extract liquid hydrocarbons ("oil") from an underground reservoir when the well can no longer naturally flow. However, pump jacks can have difficulty extracting oil from high gas-oil-ratio (GOR) reservoirs or from wells deeper than 10,000 ft.

Gas lift is an artificial-lift method used for high production rate wells (i.e., typically 2,000 barrels per day or greater) in which gas is injected into the well tubing to reduce the hydrostatic pressure of the liquid column, thereby permitting liquids to enter the tubing at a higher flow rate. Typically, the injected gas is conveyed down the annulus located between the tubing and the well casing and enters the tubing through a series of gas-lift valves located at different depths along the length of tubing. A packer must be positioned at the bottom of the casing-tubing annulus in order to isolate the annulus from the bottom end of the tubing. Gas injection continues as the liquids flow at the desired rate.

While gas lift is desired in certain down hole applications, "severe slugging" (or "heading") is not desired in any application. Severe slugging occurs when gas continues to accumulate in a reservoir cavity or in the casing-tubing annulus, with the liquid level rising in the well tubing. As gas pushes down the liquid level in the annulus and enters the tubing, the tubing hydrostatic pressure is reduced, thereby creating a lower downstream pressure. Expansion of the gas then provides the driving force to rapidly expel the liquid, along with the gas, out of the well.

Because catastrophic consequences to operators and severe damage to downstream facilities can occur during a severe slugging event, professionals in the field take measures to detect severe slugging and prevent it from occurring. This is one reason, for example, why gas lift makes extensive use of valves and chokes to stabilize the injection rate.

However, severe slugging has properties which can be useful for extracting oil from medium productivity wells (which can produce several hundred barrels per day) and from low productivity wells, such as those commonly labeled as stripper wells. A stripper well is usually defined as any oil or gas well which produces an average of 15 or less equivalent barrels of oil and gas per day. Therefore, a need exists for a system, apparatus and method to intentionally create, and then control in a safe manner, a severe slugging event.

SUMMARY OF THE INVENTION

A system and method according to this invention creates a controlled severe slugging event or eruption (similar as what occurs in a natural geyser) below a liquid residing in the column of a well tubing.

The eruption or blowout occurs when a compressed gas, which has been accumulated or injected in the annulus located between the tubing and the well casing, exits the bottom end of the annulus and enters the lower end of the well tubing. This greatly reduces the hydrostatic pressure in the tubing and increases the differential pressure, thereby accelerating the upward flow of the liquid residing in the well tubing. After the blowout has occurred, the well is depressurized and the liquid and gas accumulations start again.

Depending on the depth of the well (e.g. 5,000 feet), the volume of liquid in the column can be substantial. Additionally, the volume of the annulus can accumulate a significant amount of gas, thereby reducing the size requirement of the surface storage vessel or tank used to store or compress the gas.

A system and method according to this invention creates a controlled severe slugging (or geyser-type) event to expel or blowout liquid residing in a well tubing. The system includes a cap located at the lower end of the well tubing which prevents gas from entering the well tubing during an accumulation of the liquid in the well tubing. (A gap formed between the cap and the bottom end of the tubing permits liquid to enter the tubing.) When the liquid accumulates within the well tubing to a predetermined level, compressed gas is injected into the upper end of the annulus. The injected compressed gas pushes the liquid level down and exits a lower end of the annulus and enters a lower end of the well tubing, thereby reducing the hydrostatic pressure and causing a portion of the liquid residing in the well tubing to rapidly flow upwards and exit (erupt or blowout of) the well tubing.

At least one control valve communicates with the injection means. At no point in the system or method is the compressed gas injected directly into the well tubing via gas-lift valves or other means. And unlike gas lift, the injecting step stops once the liquid begins to flow upwards. Additionally, no packer is required at the bottom of the casing-tubing annulus.

The gas may be a gas produced by the reservoir in communication with the well tubing or, in the case of a man-made reservoir (e.g., a water fountain, pond or pool), the gas could be a supplied gas. When the gas is produced by the reservoir, the gas may be allowed to accumulate in the annulus and can be allowed to exit the upper end of the annulus and routed to a storage vessel, a separator vessel, or some combination of the two. The stored gas may then be routed to the gas compressor. Similarly, the produced liquid and gas can be routed to a separator vessel or other downstream processing equipment.

Objectives of the invention are to:

1. create a controlled geyser well, either in a natural reservoir formation or in a man-made formation such as a fountain, pond or pool;
2. take advantage of severe slugging effects by artificially creating and controlling a severe slugging event; and
3. improve the production of low productivity wells.

ELEMENT NUMBERING USED IN THE DRAWINGS AND DETAILED DESCRIPTION

Figure 2:
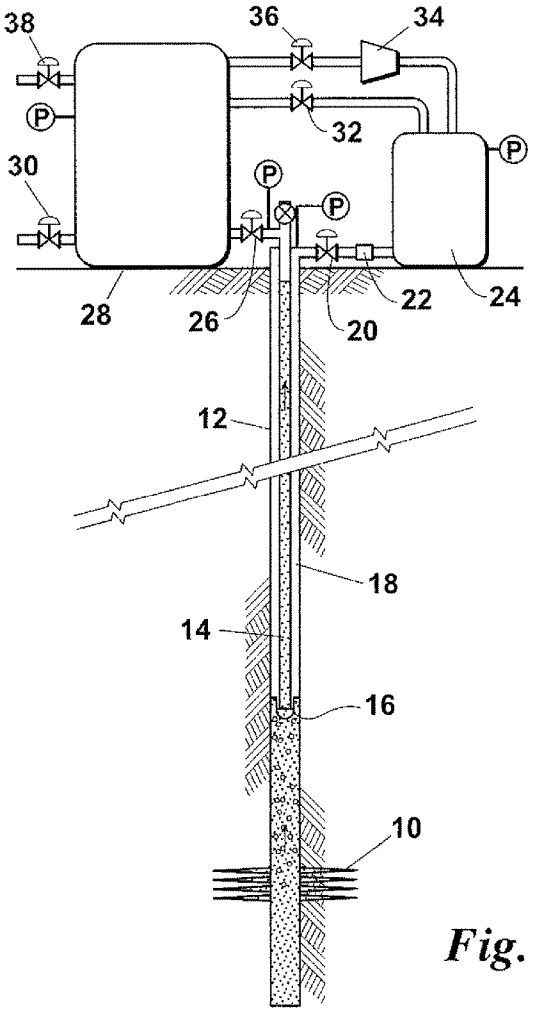
FIG. 2 continues the system and method of FIG. 1, showing the oil level in the annulus reaching the bottom end of the tubing as compressed gas is accumulated and/or injected into the annulus. As the compressed gas reaches the bottom of the well tubing, it enters the lower end of tubing. When the gas flows into the tubing, it replaces oil and reduces the fluid mixture density wherein. The hydrostatic pressure in the tubing decreases.

Perforations or Fractures 10
Casing 12
Tubing 14
Cap 16
Annulus between Casing and Tubing 18
Valves 20, 26, 30, 32, 36, 38
Flow Meter 22
Gas Tank 24
Separator 28
Compressor 34
Horizontal Wells 40
Well 110
Riser tube 112
Annulus between Casing and Tubing 113

Casing pipe 114
Air compressor 116
Air tank 118
Water pool 120
Check valve 122
Valves 124, 130
Water supply 126
Tube 128
Down corner 132
Water tank 134
Drainage 136

DETAILED DESCRIPTION OF THE PREFERRED EMBODIMENTS

Referring to the drawings in detail, FIGS. 1 through 4 illustrate diagrammatic views of one preferred system and method in accordance with the present invention.

A well is drilled into an oil and gas reservoir. It is then completed with a casing 12 and perforations (or hydraulic fractures) 10 corresponding to the reservoir thickness. A tubing 14 is inserted in the casing 12, with its bottom end covered with a cap 16 to prevent gas from entering the tubing 14 during liquid accumulation. Liquid is allowed to enter the tubing 14 through a gap formed between the cap 16 and the bottom end of the tubing 14. The top end of the tubing 14 is connected to a gas-liquid separator 28. The outer diameter of the tubing 14 is smaller than the inner diameter of the casing pipe 12, forming an annulus channel or annulus 18 in between. The casing pipe 12 is connected to a gas tank 24. Under a varying pressure drawdown, oil and gas flow from reservoir into the well. The bottom end of the tubing 14 is submerged by oil.

Figure 1:
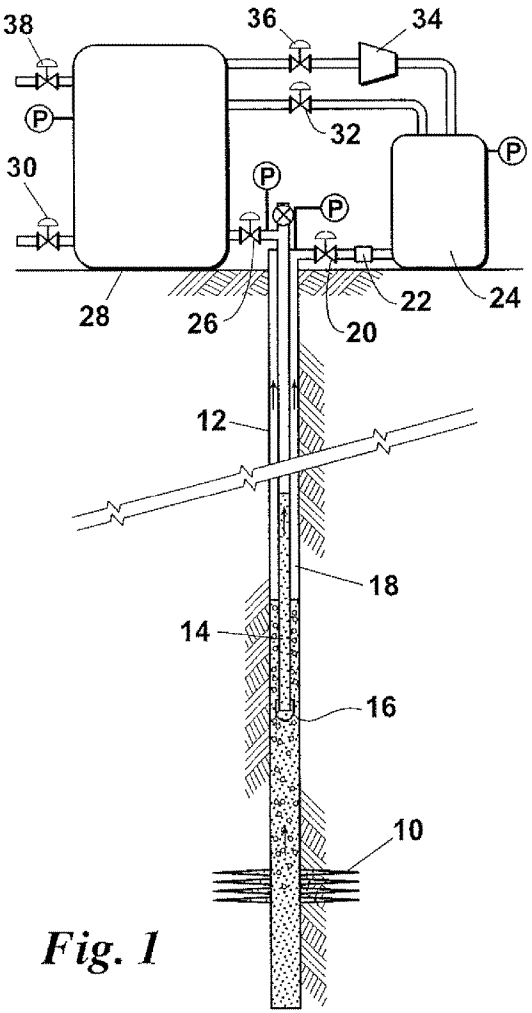
FIG. 1 is a preferred embodiment of a system and method made according to this invention. When submerged in liquid, a cap prevents gas bubbles from entering the lower end of the well tubing. The gas accumulates in the annulus between the well tubing and casing and/or flows to a surface storage vessel where the pressure increases with the gas input. At the same time, oil flows into the tubing through a gap formed between the cap and the bottom end of the well tubing.

As shown in FIG. 1, gas bubbles move upward through the oil due to buoyancy and enter the annulus 18. The cap 16 prevents the gas bubbles from entering the tubing 14. If the annulus volume is insufficient, gas further flows to the tank 24 where the pressure increases with the gas input. At the same time, oil flows into the tubing 14 through the gap between the cap 16 and the bottom end of the tubing 14. The increasing oil level creates a hydrostatic pressure at the bottom of the tubing 14 to balance the pressure in the annulus 18. This process continues until the oil level in the annulus 18 reaches the bottom end of the tubing 14, as shown in FIG. 2.

At this moment, gas starts to flow into the tubing 14. The pressure in the gas tank 24 reaches its maximum value, which equals the hydrostatic pressure in the tubing 14 plus the pressure in the separator 28. When gas flows into the tubing 14, it replaces oil and reduces the fluid mixture density wherein. The hydrostatic pressure in the tubing 14 decreases. Compressed gas in the gas tank 24 flows into the tubing 14 through the annulus 18 due to lower downstream pressure. This further reduces the density of the fluid mixture and the hydrostatic pressure in the tubing 14, resulting in higher gas flow rate. At the same time, gas expands and is released from solution in oil due to the pressure drop.

Figure 3:
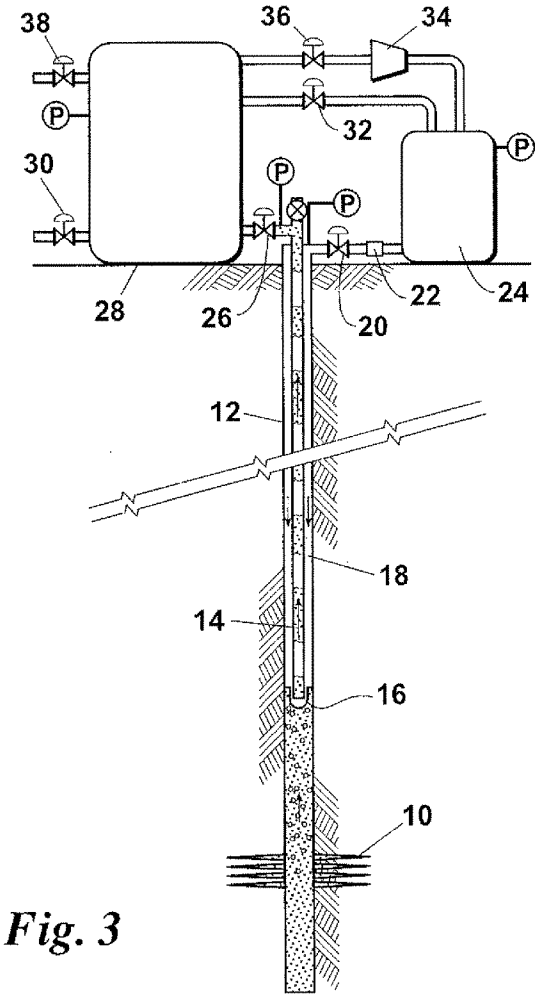
FIG. 3 continues the system and method of FIGS. 1-2, showing that the compressed gas flows faster into the tubing from the annulus due to lower downstream pressure. This further reduces the density of the fluid mixture and the hydrostatic pressure in the tubing, resulting in higher flow rate. At the same time, gas expands and is released from solution in the oil. The high speed flow from the tubing to the separator is similar as the steam-water eruption of a natural thermal geyser. Oil and gas are separated in the separator and are transferred to downstream facilities for further processing.

A high speed flow from the tubing 14 to the separator 28 is formed (as shown in FIG. 3), similar as the steam-water eruption of a natural thermal geyser. Oil and gas are separated in the separator 28 and are transferred to downstream facilities for further processing.

Figure 4:
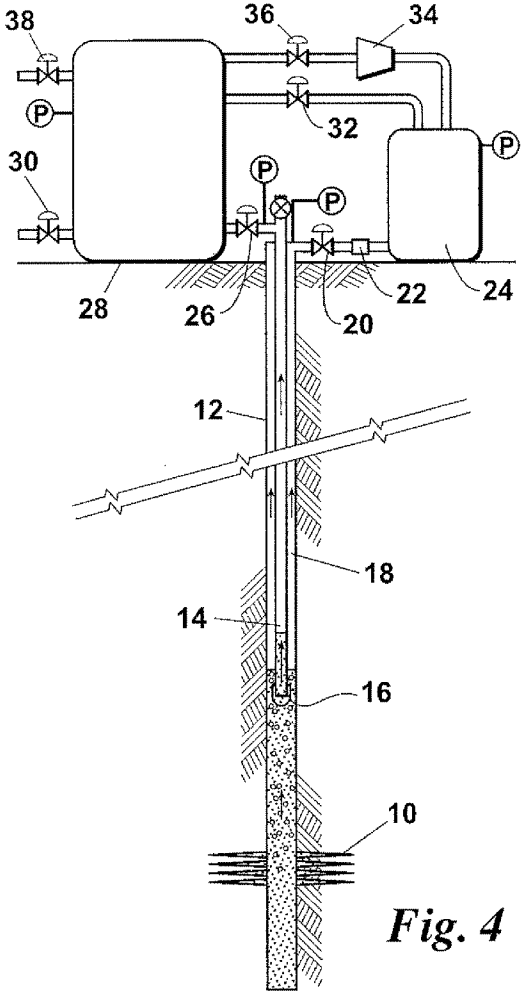
FIG. 4 continues the system and method of FIGS. 1-3, showing most of the oil being blown out of the tubing by high speed gas flow. This causes the pressure in the storage vessel to get close to the pressure of the separator. The well is depressurized and a new cycle begins.

After most of the oil in the tubing 14 is blown out by the high speed gas flow and the compressed gas is exhausted, the pressure in the gas tank 24 is close to the pressure in the separator 28. Oil film on the tubing inside wall starts to fall back and the tubing bottom end is again blocked by oil, as shown in FIG. 4. A new cycle begins.

The blowout can be controlled by valves 20 and 26. If the produced gas exceeds the need for blowout, it can be released to the separator 28 through valve 32. If the produced gas is not sufficient, gas from the previous blowout may be recycled by a compressor 34 which draws the gas from the separator 28 and charges the gas into the gas tank 24 with a higher pressure.

Figure 5:
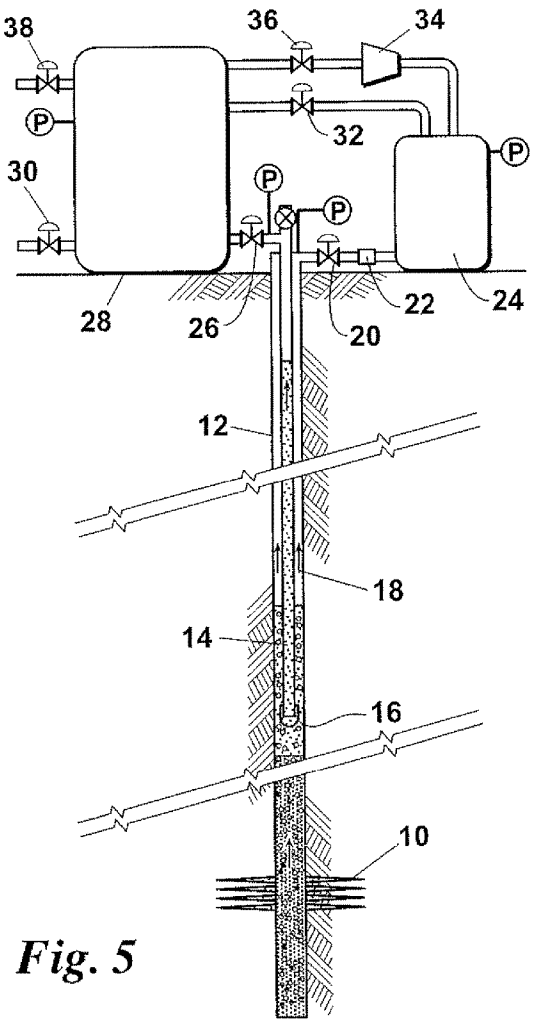
FIG. 5 continues the system and method of FIGS. 1-4, showing how the lower end of the well tubing can be set at a certain distance from the perforation and free of standing water.

As shown in FIG. 5 when free water exists in the reservoir, the tubing 14 may be set with its bottom end at a certain distance from the perforation 10. This helps separate oil from water and produce less water.

Figure 6:
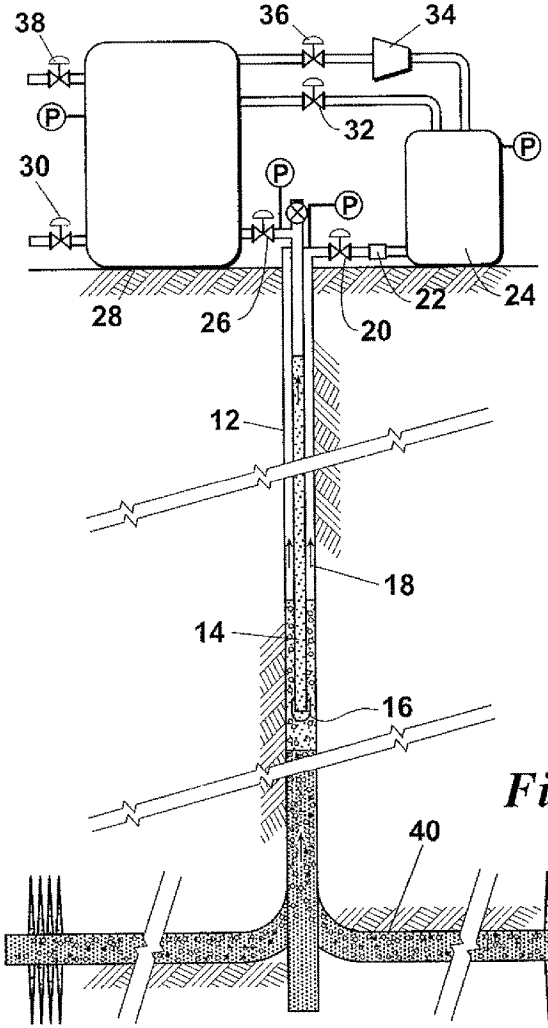
FIG. 6 shows how the system and method can be used in connection with a vertical or deviated well connected to one or more horizontal sections with section perforations or fractures.

As shown in FIG. 6, a vertical or deviated well 12 can also be connected to one or more horizontal sections 40 with section perforations or fractures. A down extension of the well 12 from the perforation can contain the produced solid particles by gravitational separation.

Referring now to FIGS. 7 through 12, another preferred embodiment of a system and method in accordance with the present invention does not rely upon a produced gas in order to create the eruption.

A well 110 is drilled into a depth required to form the desired geyser eruption height. A casing pipe 114 with closed bottom end is inserted to the bottom of the well 110. A riser tube 112 is inserted in the casing pipe 114, with its bottom end extended to near the casing pipe 114 bottom and its top end connected to a water pool 120. The outer diameter of the riser tube 112 is smaller than the inner diameter of the casing pipe 114, forming an annulus channel 113 in between. The casing pipe 114 is connected to an air tank 118 which is charged with air by an air compressor 116. Compressed air flows from the air tank 118 into the annulus channel 113 between the casing pipe 114 and the riser tube 112. A check valve 122 may be used to prevent water flowing back into the air tank 118.

Figure 7:
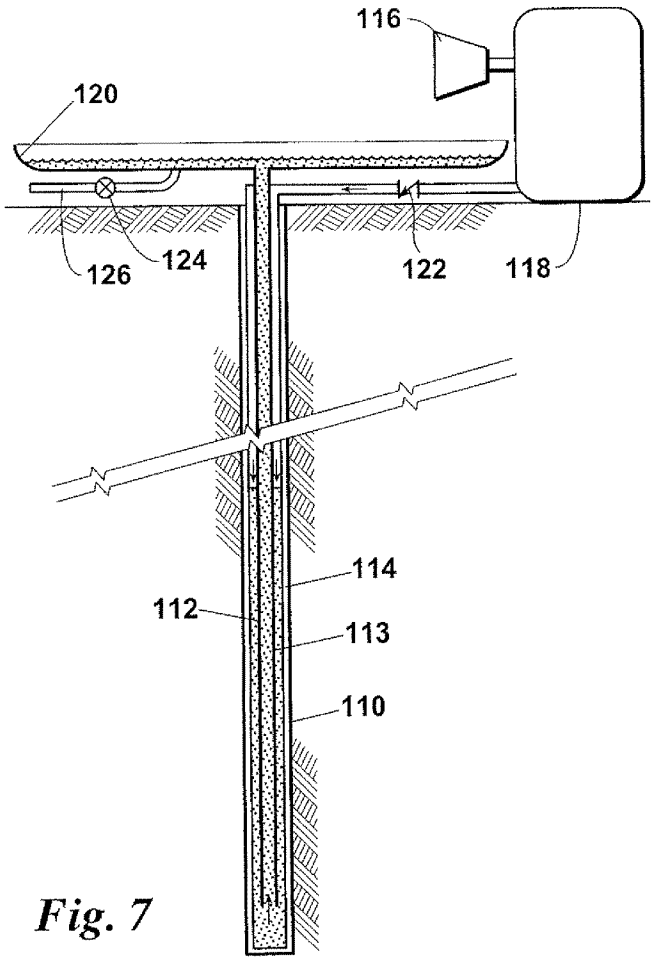
FIG. 7. is another preferred embodiment of a system and method made according to this invention and used in connection with a man-made reservoir such as a water fountain, pond or pool. Compressed air pushes water down in the annulus channel, and water flows upward in the riser tube to the water pool. Meanwhile, the pressure in the air tank increases. This pressure equals the hydrostatic pressure due to the water level difference between the water pool and the annulus channel.

As shown in FIG. 7, compressed air pushes water down in the annulus channel 113, and water flows upward in the riser tube 112 to the water pool 120. Meanwhile, the pressure in the air tank 118 increases. This pressure equals the hydrostatic pressure due to the water level difference between the water pool 120 and the annulus channel 113.

Figure 8:
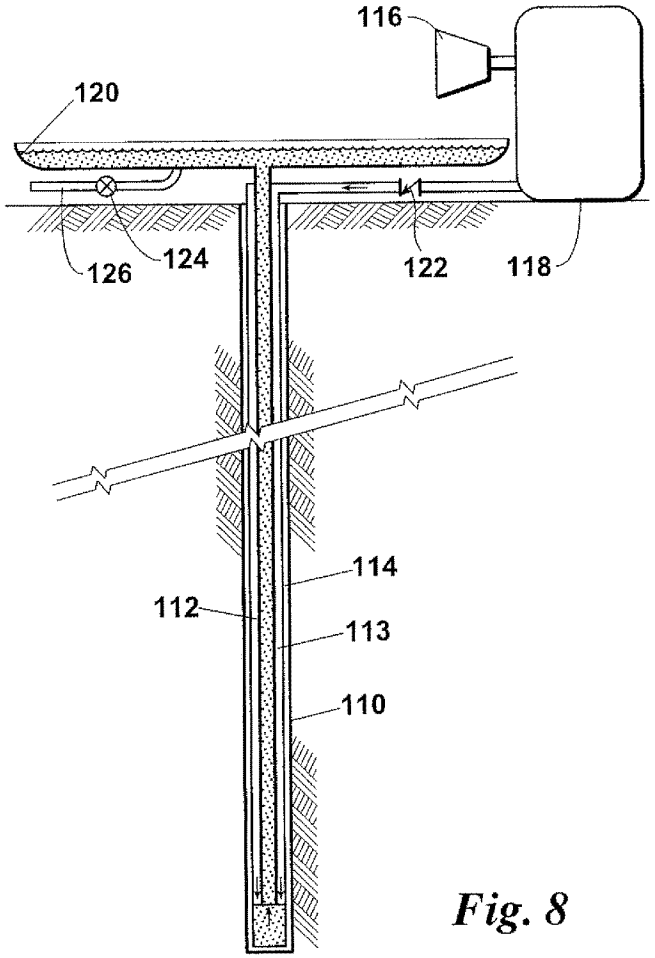
FIG. 8 continues the system and method of FIG. 7. The process continues until the water level in the annulus channel reaches the bottom inlet of the riser tube. Air starts to flow into the riser tube which replaces water and reduces the fluid mixture density therein and the hydrostatic pressure in the riser tube decreases.

This process continues until the water level in the annulus channel 113 reaches the bottom inlet of the riser tube 112, as shown in FIG. 8. At this moment, water stops flowing into the riser tube 112. The pressure in the air tank 118 reaches its maximum value which equals the hydrostatic pressure in the riser tube 112. Air starts to enter the riser tube 112. When air flows into the riser tube 112, it replaces water and reduces the fluid mixture density therein. The hydrostatic pressure in the riser tube 112 decreases. Compressed air in the air tank 118 flows faster into the riser tube 112 through the annulus channel 113 due to lower downstream pressure. This further reduces the density of the fluid mixture and the hydrostatic pressure in the riser tube 112, resulting in higher air flow rate. At the same time, air expands due to the pressure drop.

Figure 9:
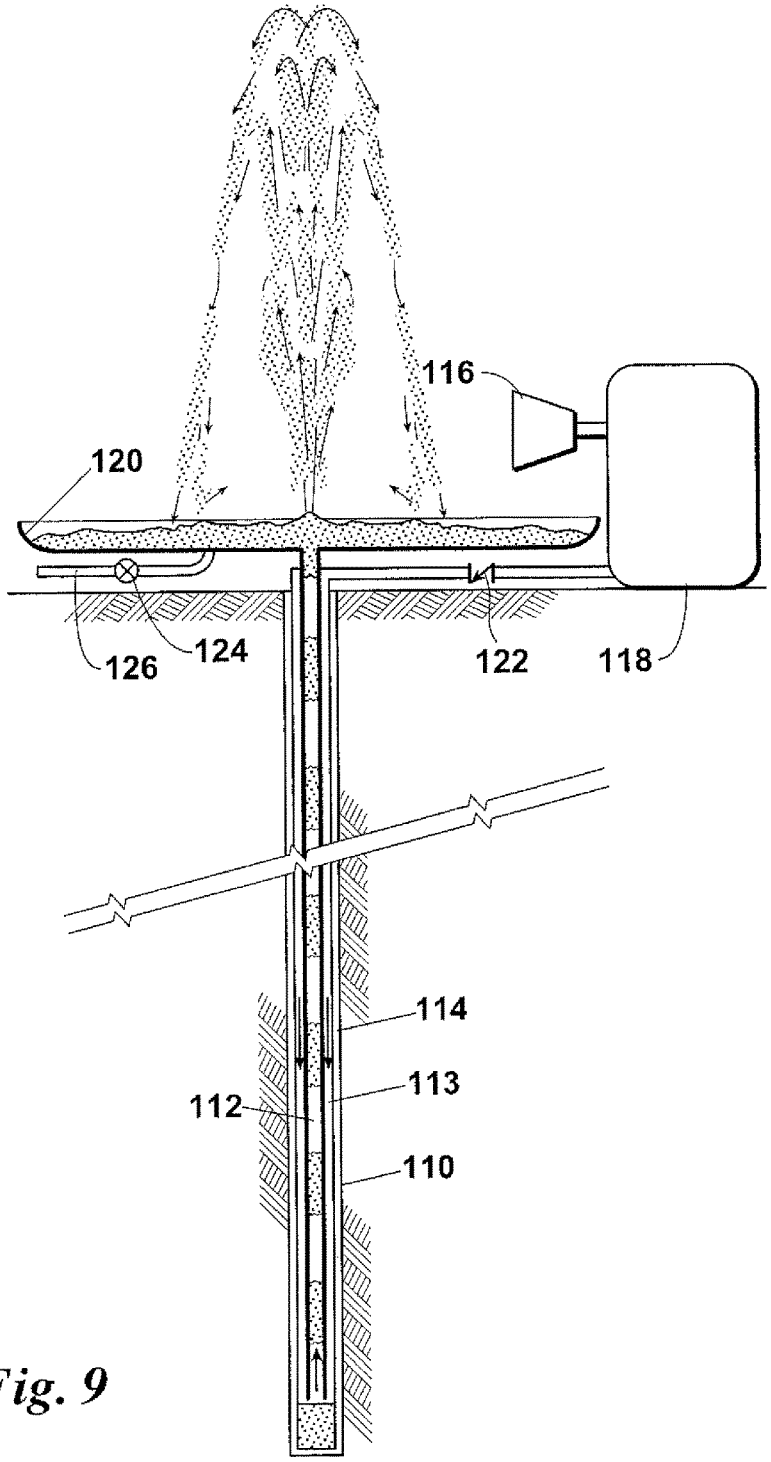
FIG. 9 continues the system and method of FIGS. 7-8. Compressed air flows faster into the riser tube through the annulus channel due to lower downstream pressure. This further reduces the density of the fluid mixture and the hydrostatic pressure in the riser tube, resulting in higher air flow rate. At the same time, air expands due to the pressure drop. An air-water eruption, similar as the steam-water eruption of a natural thermal geyser, from the riser tube is formed.

An air-water eruption from the riser tube 112 is formed (as shown in FIG. 9), similar as the steam-water eruption of a natural thermal geyser. Water erupted from the riser tube 112 is contained with a shallow pool 120. The lost water can be compensated by a water supply line 126 and a valve 124.

Figure 10:
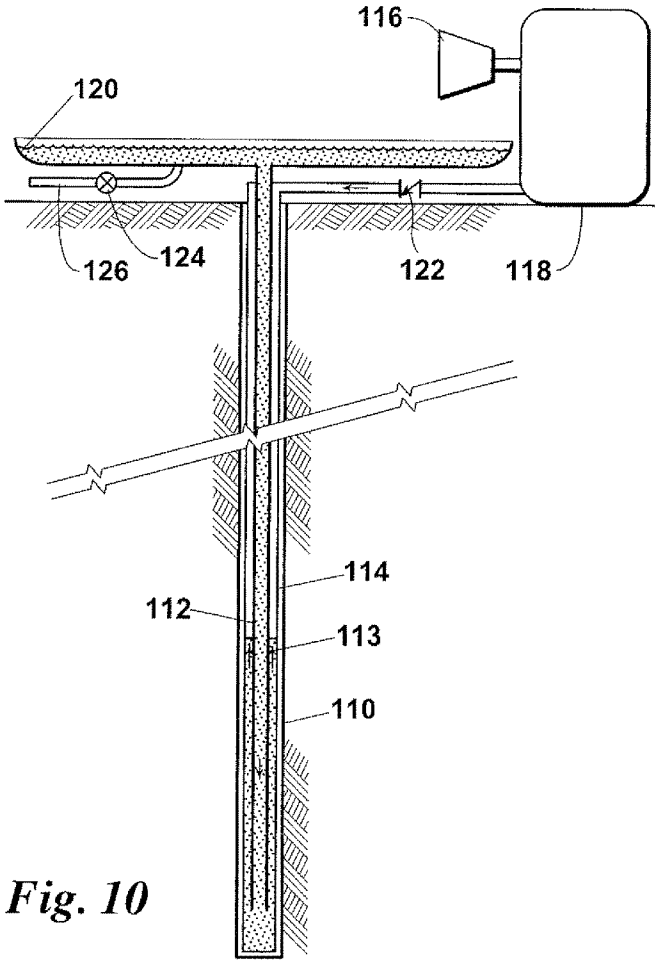
FIG. 10 continues the system and method of FIGS. 7-9. After most of the water in the riser tube is swept out by the high speed air flow and the compressed air is exhausted, the pressure in the air tank is close to the atmospheric pressure. Water starts to flow back into the riser tube and the annulus channel, until the pressure in the air tank equalizes with the hydrostatic pressure in the riser tube. Then, a new cycle begins.

After most of the water in the riser tube 112 is swept out by the high speed air flow and the compressed air is exhausted, the pressure in the air tank 118 is close to the atmospheric pressure. Water starts to flow back into the riser tube 112 and the annulus channel, as shown in FIG. 10, until the pressure in the air tank 18 equalizes with the hydrostatic pressure in the riser tube 112. Then, a new cycle begins.

Figure 11:
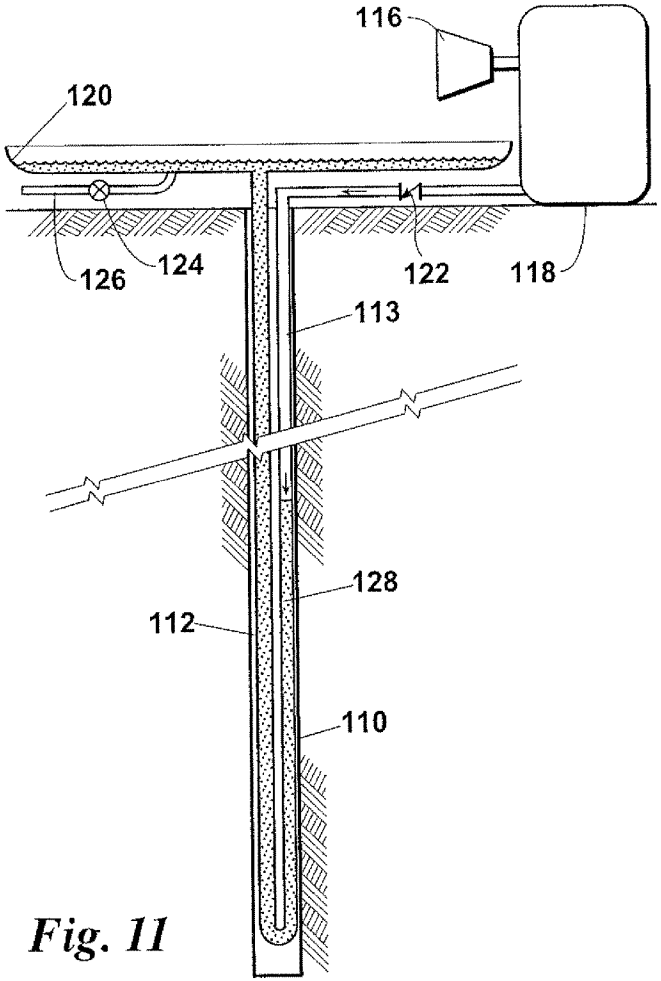
FIG. 11 shows how the casing pipe can be replaced by a tube which connects the air tank to the inlet of the riser tube at the bottom of the well.

As shown in FIG. 11, the casing pipe 114 can be replaced by a tube 128, which connects the air tank to the inlet of the riser tube 112 at the bottom of the well 110.

Figure 12:
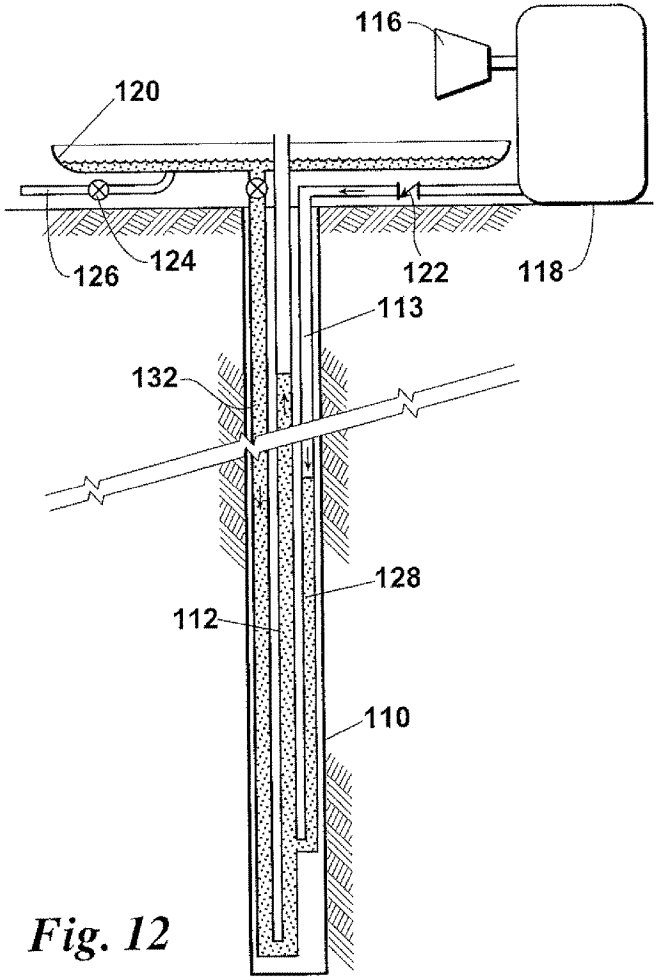
FIG. 12 shows how a down corner can be used for the water to flow back from the top water pool to the bottom of the riser tube. The water flow is regulated with a valve.

A further variation of this process is shown in FIG. 12. A down corner 132 can be used for the water to flow back from the top water pool 120 to the bottom of the riser tube 112. The water flow is regulated with a valve 130. The top end of the riser tube 112 is above the water level in the water pool 120, so that water cannot flow back to the riser tube 112. The tube 128 connection to the riser tube 112 must be higher than the water down corner 132 connection to the riser tube 112, so that compressed air cannot flow into the down corner 132.

In one non-limiting example of an application of this preferred process, a well, such as a four-inch (10.16 cm) hole diameter well, is drilled to a required depth, for example, 150 feet (45.72 m). A 4-inch (10.16 cm) casing pipe with its tip sealed is inserted into the well. A three-inch (7.62 cm) riser tube is inserted into the casing pipe to near its bottom. A 20 cubic feet (about 0.57 $m^3$) air tank is connected to the top of the annulus channel formed between the riser tube and the casing pipe. A 100 psi (about 690 kpa) and 3 cubic feet per minute (about 0.085 $m^3$/min) air compressor is used to charge the air tank. The shallow water pool can be set on the ground to contain the erupted water.

An alternate preferred process is illustrated in FIGS. 13 through 17. Water tank 134 is fully or partially filled with water. A riser tube 112 is connected to the water tank 134 from the top with its inlet extended to near the bottom of the water tank 134. The riser tube 112 can be set vertical or deviated from vertical to a certain degree. The height of the riser tube 112 determines the strength of the geyser it creates.

Figure 13:
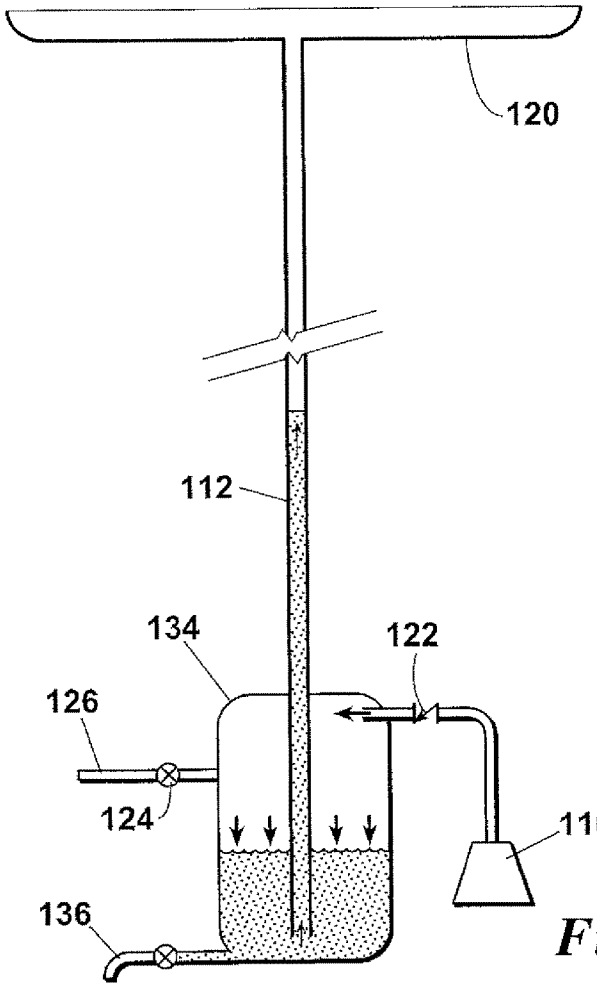
FIG. 13 is yet another preferred embodiment of a system and method according to this invention. The water tank is fully or partially filled with water and a riser tube is connected to the water tank from the top with its inlet extended to near the bottom of the water tank. The riser tube can be set vertically or deviated from vertical to a certain degree. The height of the riser tube determines the strength of the geyser it creates.
Figure 15:
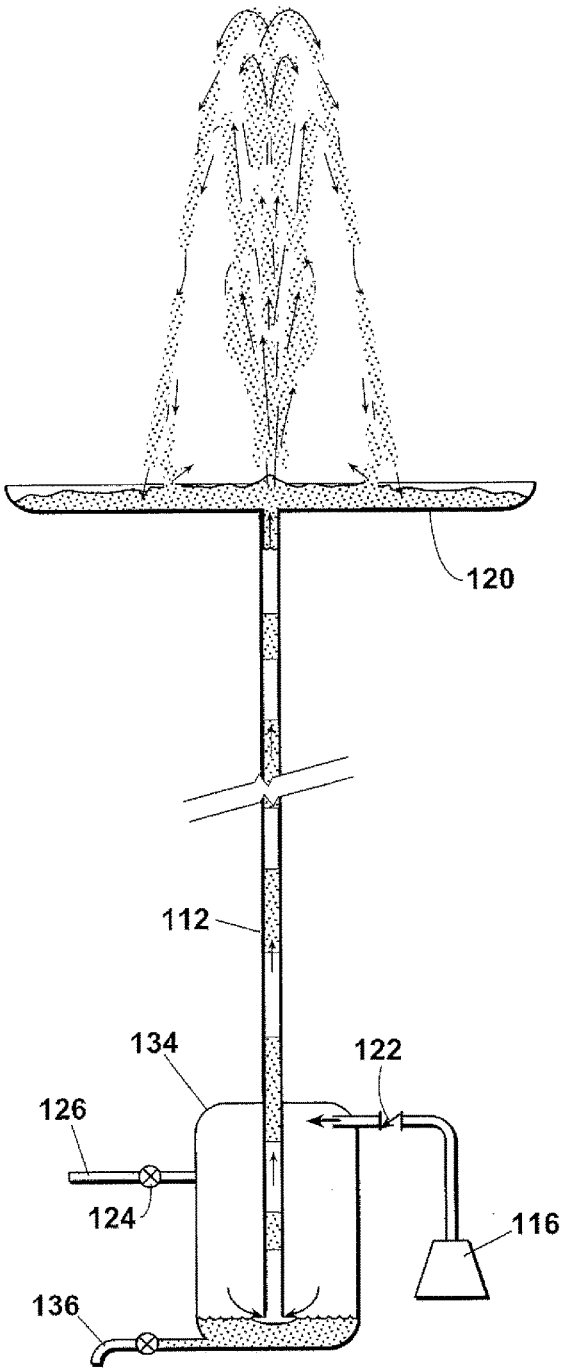
FIG. 15 continues with the system and method of FIGS. 13-14. An air-water eruption from the riser tube is formed, similar to the steam-water eruption of a natural thermal geyser.
Figure 19:
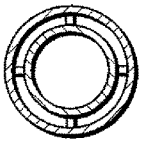
FIG. 19 is a top view of the cap of FIG. 18.
Figure 18:
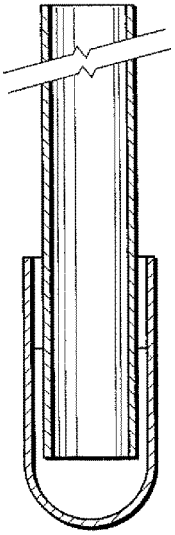
FIG. 18 is a side view of a preferred embodiment of the cap used to prevent gas from entering the tubing during liquid accumulation. Liquid is allowed to enter the tubing through a gap formed between the cap 16 and the bottom end of the tubing.

As shown in FIG. 13, compressed air is charged by an air compressor 116 into the water tank 134. A check valve 122 may be used to prevent back flow. Pressure inside the water tank 134 increases and water level in the riser tube 112 rises. The hydrostatic pressure caused by the liquid level difference between the riser tube 112 and the water tank 134 equals the static pressure inside the water tank 134.

Figure 14:
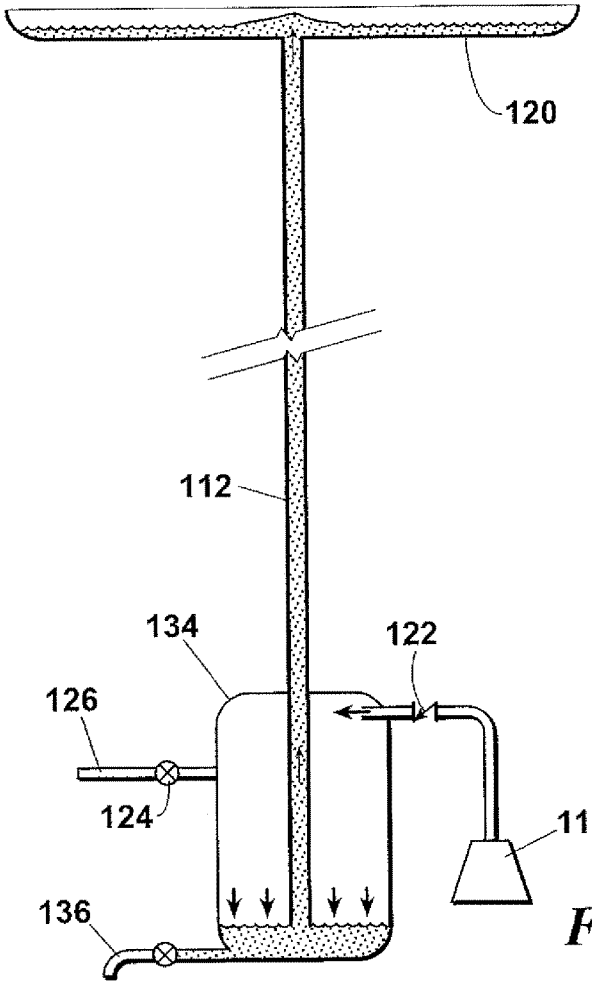
FIG. 14 continues with the system and method of FIG. 13. As the water level in the water tank reaches the inlet of the riser tube, water stops flowing into the riser tube and the pressure in the water tank reaches its maximum value. Air then starts to enter the riser tube, thereby replacing water and reducing the fluid mixture density therein. Because of this the hydrostatic pressure in the riser tube decreases and the compressed air in the water tank flows faster into the riser tube. This further reduces the density of the fluid mixture and the hydrostatic pressure in the riser tube, resulting in higher air flow rate. At the same time, air expands due to pressure drop.

This process continues until the water level in the water tank 134 reaches the inlet of the riser tube 112, as shown in FIG. 14. Then, water stops flowing into the riser tube 112. The pressure in the water tank 134 reaches its maximum value. Air starts to enter the riser tube 112. As air flows into the riser tube 112, it replaces water and reduces the fluid mixture density therein. The hydrostatic pressure in the riser tube 112 decreases. The compressed air in the water tank 134 flows faster into the riser tube 112 due to the lower downstream pressure. This further reduces the density of the fluid mixture and the hydrostatic pressure in the riser tube 112, resulting in higher air flow rate. At the same time, air expands due to pressure drop.

Figure 16:
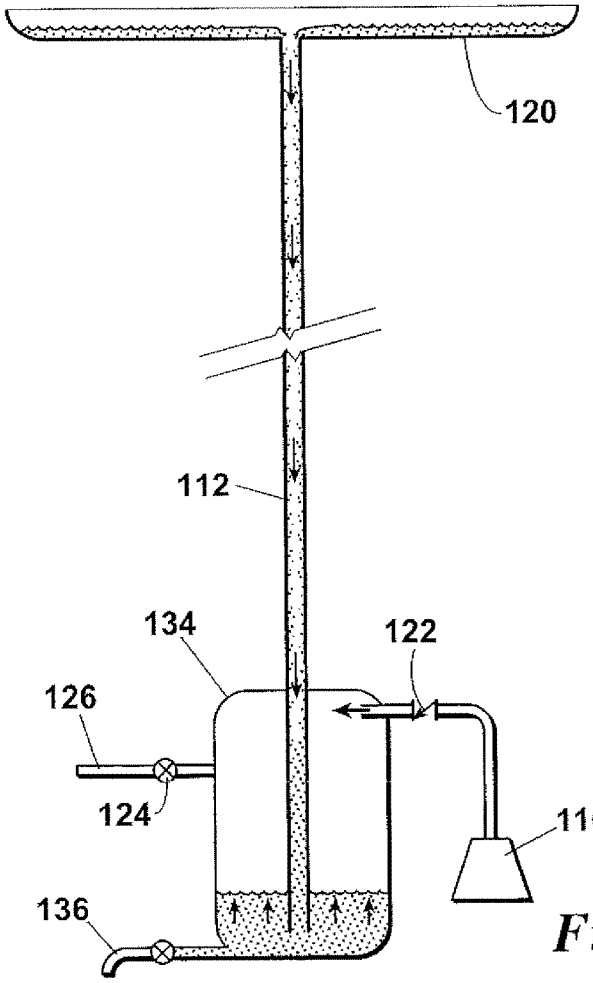
FIG. 16 continues with the system and method of FIGS. 13-15. The water starts to flow back into the water tank through the riser tube until the pressure in the water tank equalizes again with the hydrostatic pressure in the riser tube. A new cycle begins.

An air-water eruption from the riser tube 112 is formed (shown in FIG. 15), similar as the steam-water eruption of a natural thermal geyser. The water is contained with a shallow pool 120 at the top of the riser tube 112. After most of the water in the riser tube 112 is swept out by the high speed air flow and the compressed air is exhausted, the pressure in the water tank 134 is almost equal to the atmospheric pressure. The water starts to flow back into the water tank 134 through the riser tube 112, as shown in FIG. 16, until the pressure in the water tank 134 equalizes again with the hydrostatic pressure in the riser tube 112. Then, a new cycle begins.

The lost water can be compensated by a water supply line 126 and a valve 124. Excessive water due to rain or snow accumulated by the top pool can be drained through the drainage line 136.

Figure 17:
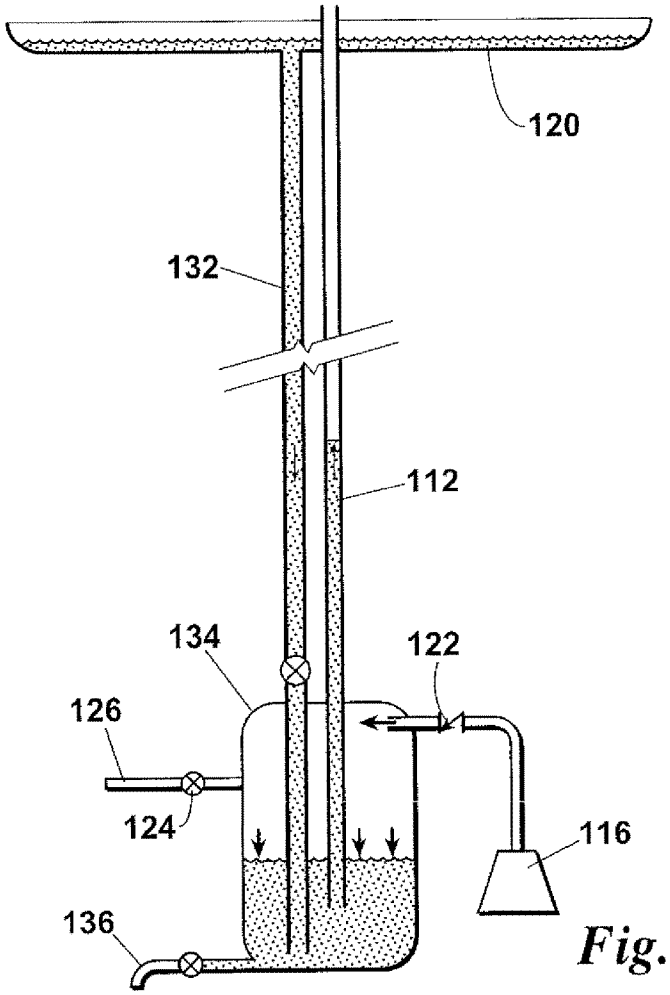
FIG. 17 is a further variation of the system of FIG. 13. At least one down corner can be used for the water to flow back from the top water pool to the water tank and regulated with a valve.

A further variation of this process is shown in FIG. 17. At least one down corner 132 can be used for the water to flow back from the top water pool 120 to the water tank 134 and regulated with a valve 130. The top of the riser tube 112 is above the water level in the water pool 120, so that water cannot flow back to the water tank 134 through the riser tube 112. The bottom end of the down corner 132 must be lower than the inlet of the riser tube 112, so that compressed air cannot enter the down corner 132.

In one non-limiting example of an application of this preferred process, a three barrel (3 bbl) water tank is filled with 2 bbl water. A three-inch (7.62 cm) inner diameter and 100 foot (30.48 m) long riser tube is inserted to near the bottom of the water tank where the majority of water is above the inlet of the riser tube. The riser tube can be set up in vertical or near vertical position on a hill side or along a building. A 60 psi (about 414 kpa) and 3 cubic feet per minute (about 0.085 $m^3$/min) air compressor can be used to charge the water tank. The shallow water pool can be set up on the top of a hill or a building to contain the erupted water.

While the invention has been described with a certain degree of particularity, modifications may be made in the details of construction and the arrangement of components and steps without departing from the spirit and scope of this disclosure. Therefore, the invention is limited by the following claims and not limited to the embodiments presented here for the purpose of explaining the system and method.

What is claimed is:

1. A system for creating a sustained controlled geyser well with periodical production, the system comprising:

a closed end cap forming an annular space between the cap and a lower end of a well tubing, the annular space having an opening above the lower end of the well tubing, and allowing liquid to enter through the annular space and accumulate in the well tubing until the liquid within an annulus located between the well tubing and a well casing reaches a predetermined level;

means for compressing produced gas; and means for periodically injecting the compressed gas into an upper end of the annulus;

wherein the means for periodically injecting the compressed gas deploys after the liquid reaches the predetermined level;

the compressed gas exiting a lower end of the annulus and entering the lower end of the well tubing through the annular space, thereby reducing hydrostatic pressure inside the well tubing and causing the liquid residing in the well tubing to flow upwards and exit the well tubing.

2. A system according to claim 1 wherein the injecting means stops injecting the compressed gas into the upper end of the annulus when the liquid residing in the well tubing begins to flow out of the well tubing.

3. A system according to claim 1 wherein the liquid and the compressed gas enter a separator vessel after flowing out of the well tubing.

4. A system according to claim 1 wherein at least a portion of the produced gas originates in a reservoir in communication with the well tubing and is accumulated in the annulus during the liquid accumulation in the well tubing.

5. A system according to claim 4 wherein a portion of the accumulated gas exits the upper end of the annulus and is routed into at least one of a storage vessel and a separator vessel.

6. A system according to claim 5 further comprising means for routing the separator vessel gas back to the compressing means.

7. A system according to claim 1 further comprising at least one control valve, the control valve being in communication with the injection means.

8. A system according to claim 1 wherein the predetermined level is the lower end of the well tubing.

* * * * *